US009339138B2

(12) United States Patent
Eslami et al.

(10) Patent No.: US 9,339,138 B2
(45) Date of Patent: May 17, 2016

(54) HAIR CARRIER BAG

(71) Applicant: Bellami Hair, LLC, Simi Valley, CA (US)

(72) Inventors: Nikki Eslami, Simi Valley, CA (US); Julius Salerno, Simi Valley, CA (US)

(73) Assignee: BELLAMI, HAIR, LLC, Simi Valley, CA (US)

( * ) Notice: Subject to any disclaimer, the term of this patent is extended or adjusted under 35 U.S.C. 154(b) by 0 days.

(21) Appl. No.: 14/733,650

(22) Filed: Jun. 8, 2015

(65) Prior Publication Data

US 2015/0351574 A1 Dec. 10, 2015

Related U.S. Application Data

(60) Provisional application No. 62/008,728, filed on Jun. 6, 2014.

(51) Int. Cl.

| | |
|---|---|
| ***A47G 29/08*** | (2006.01) |
| ***B65D 33/14*** | (2006.01) |
| ***A41G 5/00*** | (2006.01) |
| ***B65D 33/04*** | (2006.01) |
| ***A47G 25/48*** | (2006.01) |
| ***A47G 25/54*** | (2006.01) |

(52) U.S. Cl.

CPC ..... *A47G 29/08* (2013.01); *A41G 5/004* (2013.01); *A47G 25/483* (2013.01); *A47G 25/54* (2013.01); *B65D 33/04* (2013.01); *B65D 33/14* (2013.01)

(58) Field of Classification Search

CPC ... A47G 25/48; A47G 25/481; A47G 25/483; A47G 25/487; A47G 2025/484; A47G 25/54; A47G 25/56; A47G 29/08; B65D 33/04; B65D 33/14

See application file for complete search history.

(56) References Cited

U.S. PATENT DOCUMENTS 2,481,102 A * 9/1949 Frost ..... A47G 25/54 206/282
5,097,996 A * 3/1992 Chen ..... A47G 25/483 223/85
5,249,719 A * 10/1993 Hulyk ..... A47G 25/483 223/95

* cited by examiner

*Primary Examiner* — Andrew Perreault
(74) *Attorney, Agent, or Firm* — Cislo & Thomas, LLP

(57) ABSTRACT

A hair carrying system to carry hairpieces, such as hair extensions, utilizing a hanger to hold the hairpiece, and an elongated bag having an opening through which the hanger with the hairpiece can be introduced inside the bag, the bag having a top slit through which a hook portion of the hanger can protrude so that the hanger can hang the hairpiece and the bag in a safe location.

1 Claim, 5 Drawing Sheets

HAIR CARRIER BAG

CROSS-REFERENCE TO RELATED APPLICATION

This patent application claims the benefit of U.S. Provisional Patent Application Ser. No. 62/008,728, entitled "Hair Carrier Bag," filed Jun. 6, 2014, which application is incorporated in its entirety here by this reference.

TECHNICAL FIELD

This invention relates to a bag for carrier a hair piece.

BACKGROUND

Hairpieces, such as wigs, hair extensions, and the like, are popular for making a fashion statement or for covering up balding or missing hair. Although many solutions are sought after for attaching hair extensions to the hair, not much attention has been directed to the problem of caring for the hair extensions. In addition, as most people simply wear their hair extensions, not much attention has been given to options for transporting hair extensions when not in use.

Given the growing popularity of using hair extensions, and there is a need for finding a solution for easily storing and transporting hair pieces when not in use.

SUMMARY

The present invention is directed to a hair carrier bag for carrying hairpieces, such as hair extensions, when not in use. The hair carrier bag of the present invention comprises an elongated bag and a hanger that can clamp a hairpiece and be inserted into the elongated bag with a portion of the hanger sticking out from the top of the elongated bag so that the hairpiece inside the elongated bag can be fixed on to an object, such as a rod. The bag can have a transparent portion on at least one side so that the hairpiece can be easily seen and identified for quick and easy selection.

The hanger comprises a hook portion to facilitate hanging the bag, and a clamp portion to clamp the hairpiece, wherein the hook portion is operatively connected to the clamp portion, such that the hook portion provides the means for causing the clamp portion to have a closed configuration and an open configuration.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
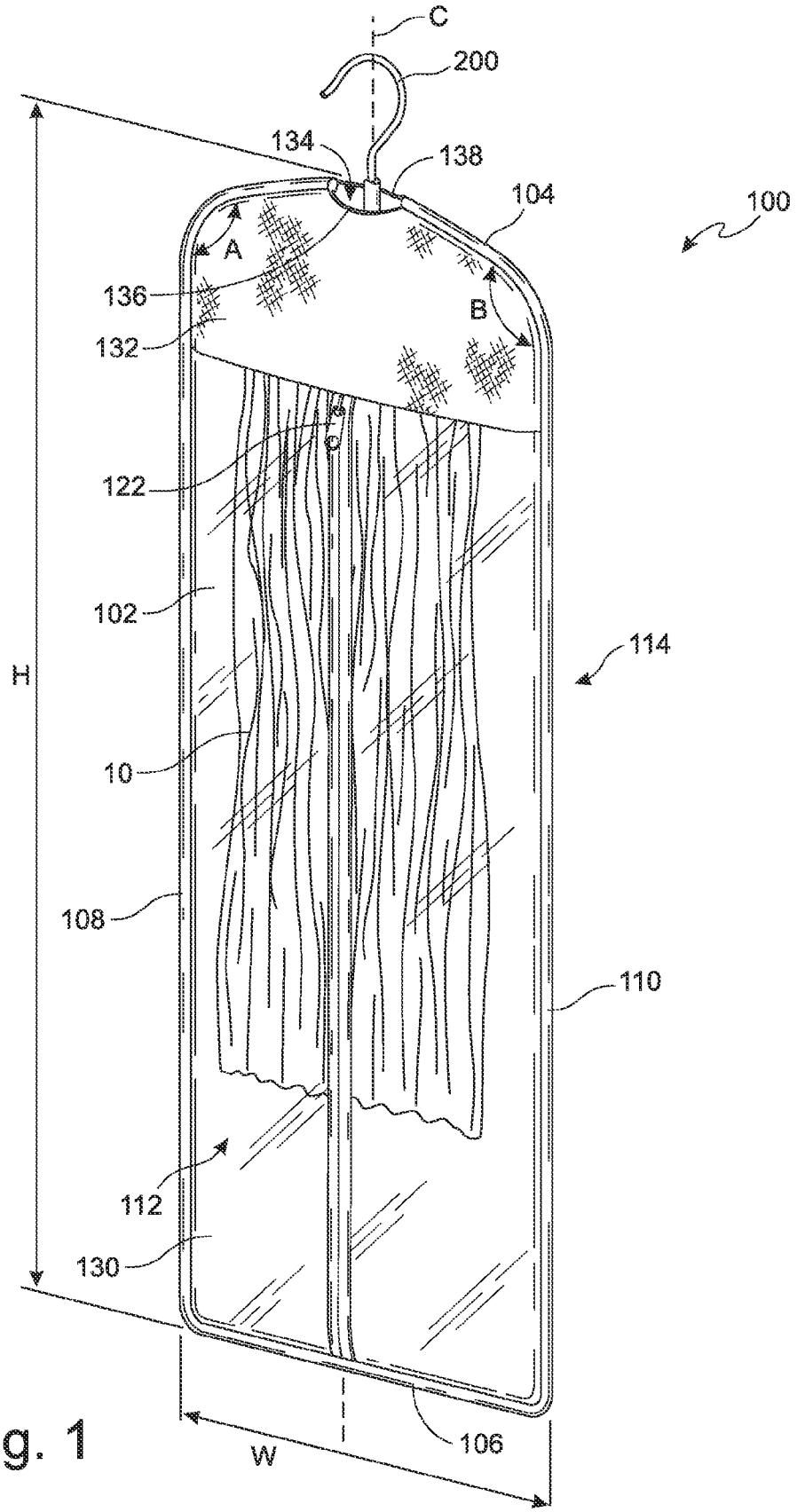
FIG. 1 shows a perspective view of an embodiment of the present invention.

The present invention is directed towards a device for carrying a hair piece in a safe and convenient manner. As shown in FIG. 1, the hair carrier device 100 comprises a bag 102 and, optionally, a hanger 200 that can be operatively connected to the bag 102 to hang the hair piece safely inside the bag 102.

The bag 102 comprises a top edge 104, a bottom edge 106 opposite the top edge 104, a first side edge 108 adjacent to the top edge 104 and the bottom edge 106, and a second side edge 110 opposite the first side edge 108 and adjacent to the top edge 104 and the bottom edge 106, a front side 112 bound by the top edge 104, the bottom edge 106, the first side edge 10, and the second side edge 110, and a back side 114 opposite the front side 112 and operatively connected to the front side 112 along at least the first side edge 10, the second side edge 110, and the bottom edge 106 to define an interior compartment. For ease of description, the distance from the bottom edge 106 to the top edge 104 is referred to as the height H, and the distance from one side edge 108 to the other side edge 110 is referred to as the width W. In the preferred embodiment, the bag 100 may be an elongated bag having the height H greater than the width W.

Figure 2:
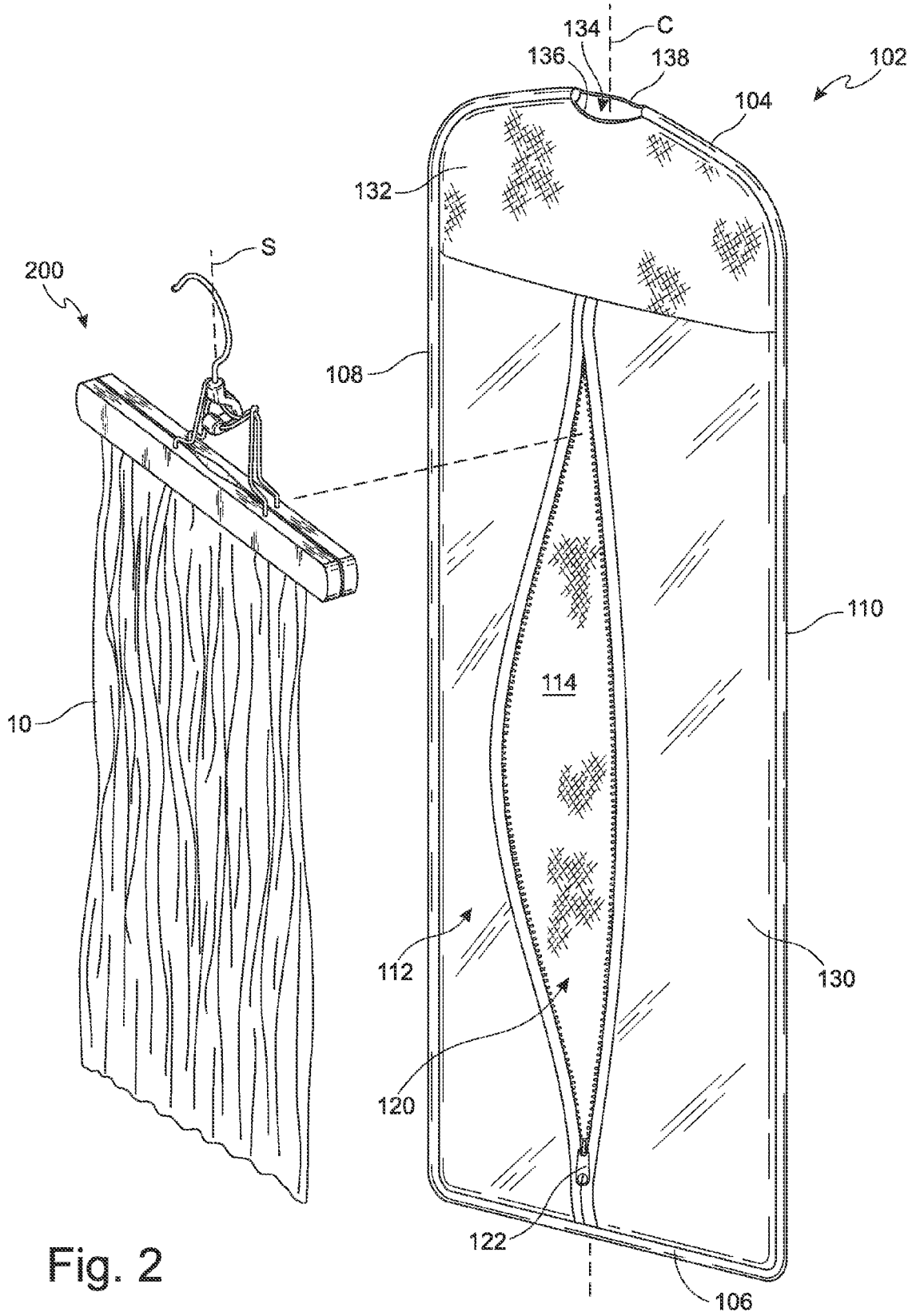
FIG. 2 shows a perspective view of an embodiment of the present invention then used.

As shown in FIG. 2, preferably, the front side 112 comprises an opening 120 along a center line C equidistant from the first side 108 and the second side 110, and a fastener 122 associated with the opening 120 to close the opening 120 to allow and prevent access to the interior compartment. The fastener can be any type of fastener, such as a zipper, hook-and-loop fasteners, buttons, magnets, hooks, clasps, and the like. The opening 120 and the fastener 122 may extend substantially from the bottom edge 106 to at least approximately 70 percent of the height H towards the top edge 104. Preferably, the opening 120 and fastener 122 extend from the bottom edge 106 to at least approximately 75 percent of the way to the top edge 104. Most preferably, the opening 120 and the fastener 122 extend from the bottom edge 106 to approximately 80 percent to approximately 85 percent of the way to the top edge 104.

In some embodiments, the opening 120 may be offset from the center line C. In some embodiments, the opening 120 may be on the back side 114, along one or both of the side edges 10, 110, along the bottom edge 106, along the top edge 104, or any combination thereof to increase the options for how to place the hairpiece into the bag 102.

In the preferred embodiment, the front side 112 has a transparent portion 130. However, the front side 112 may be opaque. Preferably, at least approximately 70 percent of the front side 112 is transparent. More preferably, at least approximately 75 percent of the front side 112 is transparent. Most preferably, approximately 80 percent to approximately 85 percent of the front side 112 is transparent. The transparent portion 130 may extend from substantially one side edge 108 to the opposite side edge 110. In addition, the transparent portion 130 may extend substantially from the bottom edge 106, but not extend all the way to the top edge 104, leaving a small opaque portion 132 adjacent to the top edge 104. The small opaque portion 132 may be approximately at least approximately 30 percent of the front side 112. More preferably, the small opaque portion 132 is at least approximately 25 percent of the front side 112. Most preferably, the small opaque portion 132 is approximately 80 percent to approximately 85 percent of the front side 112. In the preferred embodiment, the central opening 120 and the fastener 122 is on the transparent portion 130.

The transparent portion 130 may be made of a plastic material, such as polyvinyl chloride or poly(vinyl chloride) (PVC); however, other types of transparent materials can be used. The small opaque portion 132 may be made from any type of synthetic or non-synthetic material, such as cotton, nylon, polyester, and the like, and any combination thereof. The back side 114 is also substantially opaque and may be made from the same material as the small opaque portion 132. However, in some embodiments, the back side 114 may be transparent, or have a transparent portion 130 as described for the front side 112.

The top edge 104 and the first side edge 108 define a first obtuse angle A, and the top edge 104 and the second side edge 110 define a second obtuse angle B. In some embodiments, the top edge 104 and the first side edge 108 define a right angle, and the top edge 104 and the second side edge 110 define a second right angle. The top edge 104 comprises a central slit 134 approximately equidistant from the first side edge 108 and the second side edge 110. Therefore, the front side 112 and the back side 114 may be attached together along the first side edge 10, the second side edge 110, the bottom edge 106 and a substantial portion of the top edge 104, except at the central slit 134. Therefore, the central slit 134 is defined by a front central top edge 136 and a back central top edge 138.

When viewed from the front 112 or back side 114, the top edge 104 is non-parallel relative to the bottom edge 106 because the top edge 104 rises upwardly as it moves towards the central slit 134. The top edge 104 at the central slit 134 (i.e. the front central top edge 136 and the back central top edge 138) deviates back towards the bottom edge 106 creating a broad "V" or "U"-shape. The height of the "V" or "U"-shape is approximately 0.5 inch to approximately 2 inches. Preferably, the height of the "V" or "U"-shape is approximately 1 inch. The width of the central slit 134 is approximately 5 inches or less. More preferably, the width of the slit 134 is approximately 4 inches or less. Most preferably, the width of the central slit 134 is approximately 2 inches to approximately 3 inches. The hanger 200 is placed inside the bag 102 through the central opening 120 and a portion of the hanger 200 is pulled out through the central slit 134 with the remainder of the hanger inside the bag 102 holding the hairpiece.

Figure 3:
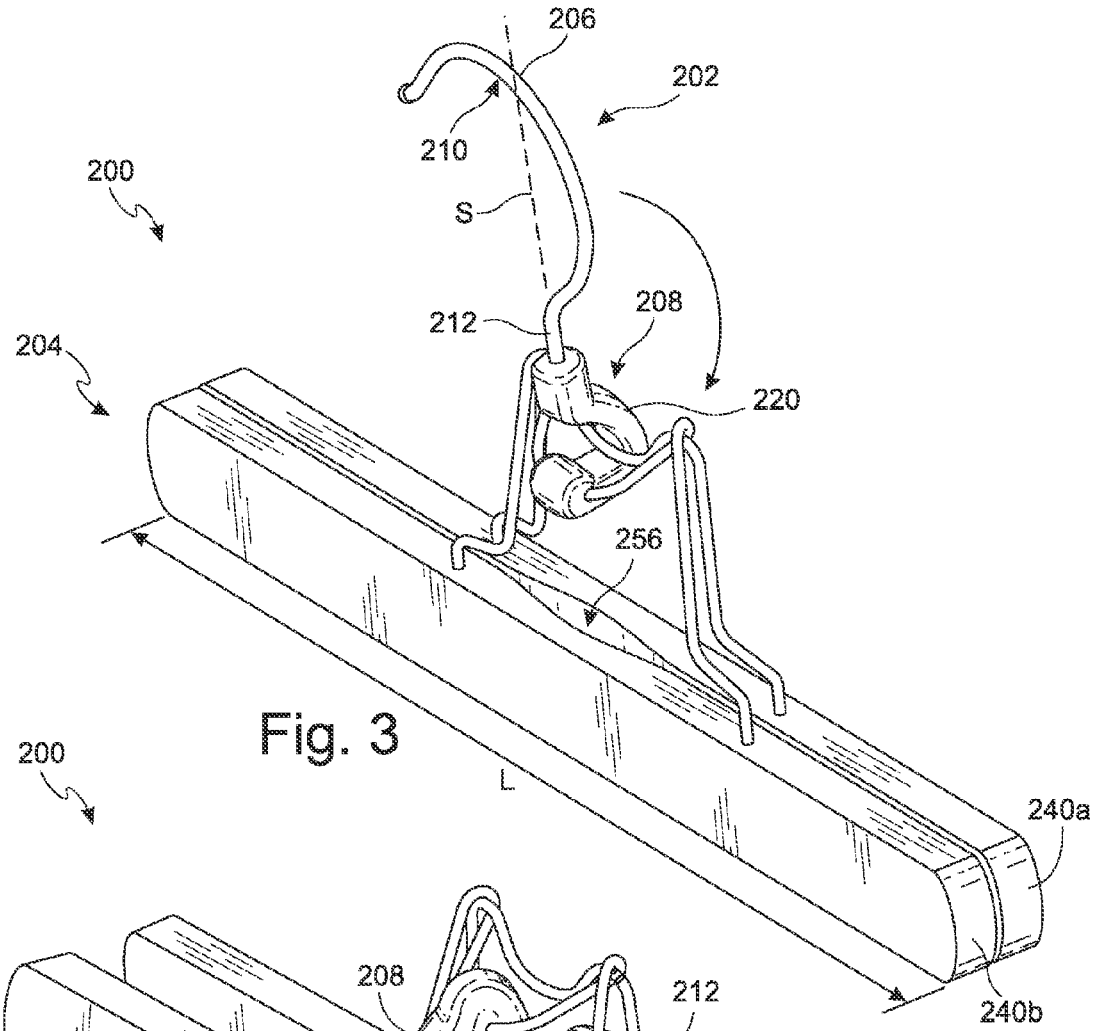
FIG. 3 shows a perspective view of an embodiment of the hanger in the closed configuration.
Figure 4:
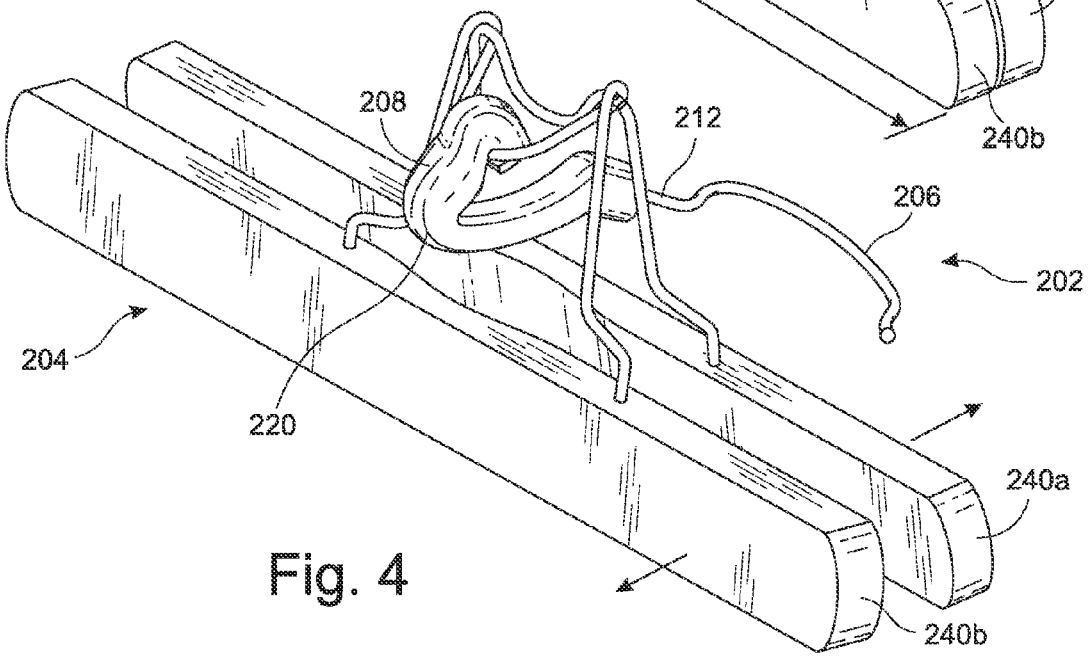
FIG. 4 shows a perspective view of an embodiment of the hanger in the open configuration.
Figure 5:
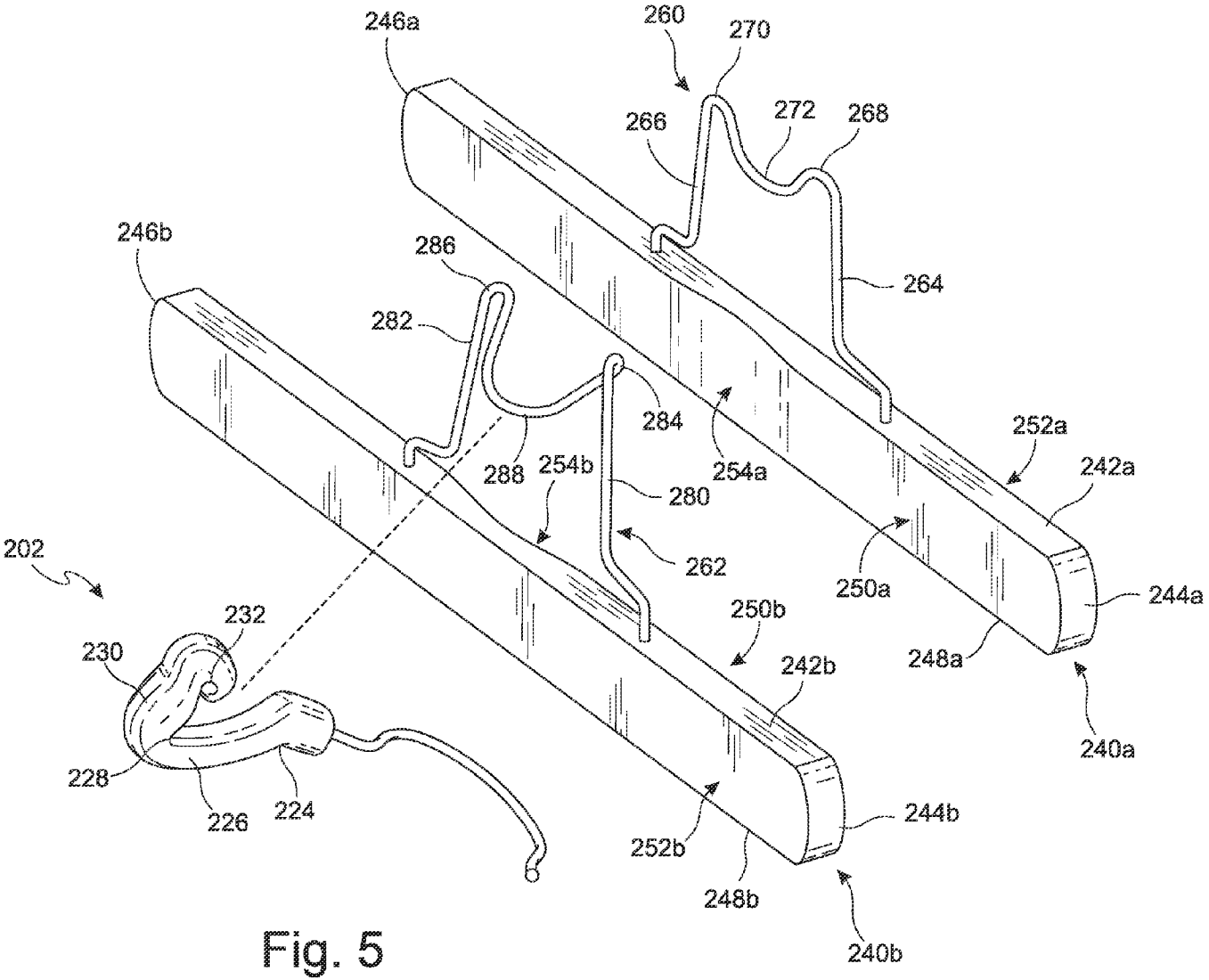
FIG. 5 shows an exploded view of the hanger.
Figure 6:
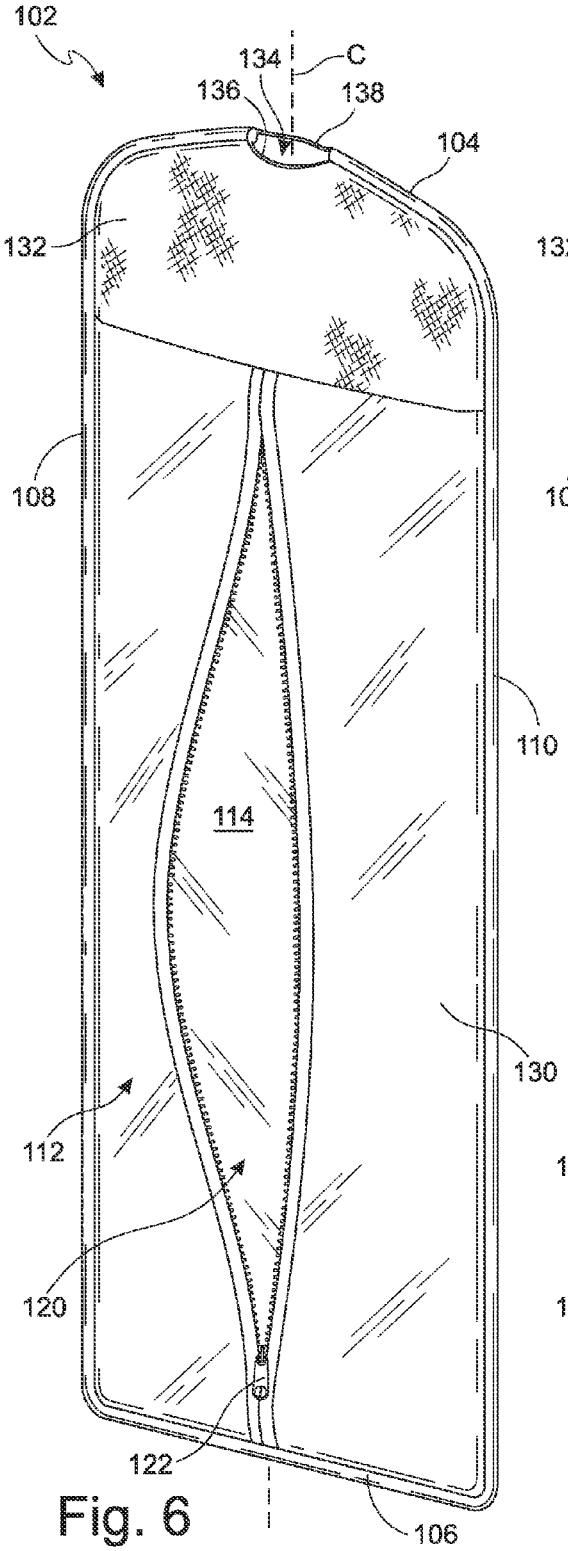
FIG. 6 shows a perspective view of another embodiment of the present invention.
Figure 7:
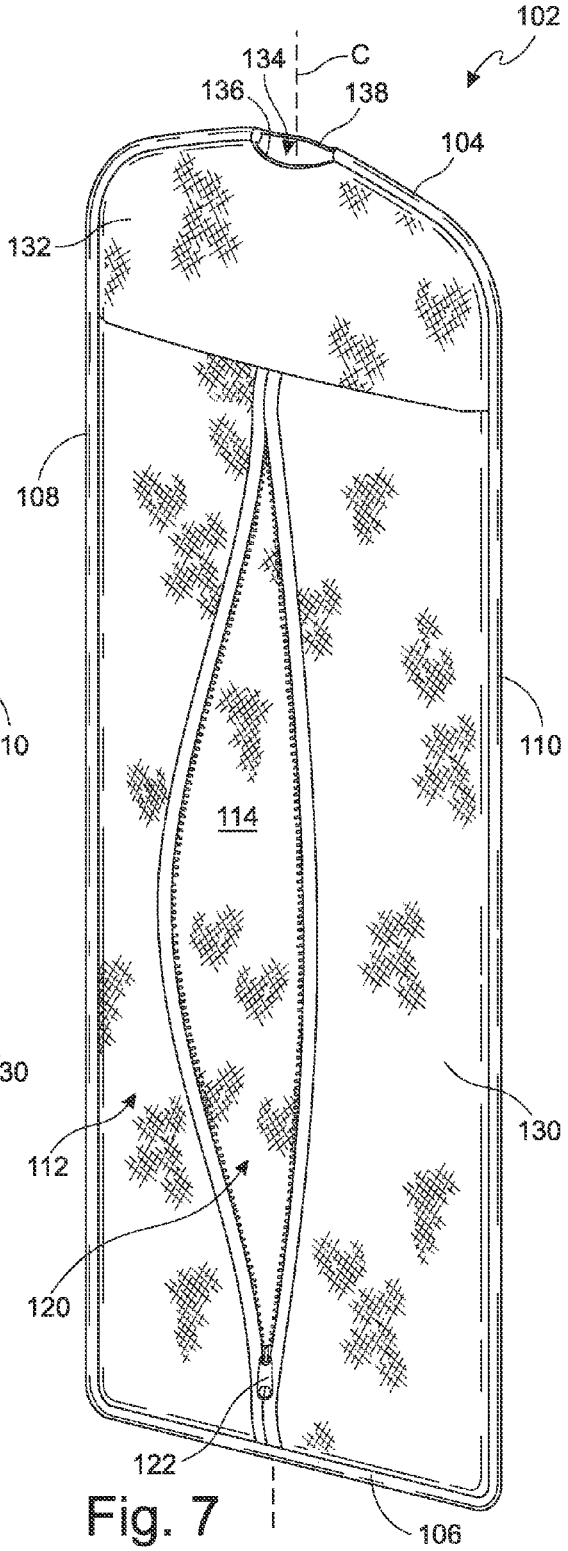
FIG. 7 shows a perspective view of another embodiment of the present invention.

As shown in FIGS. 3-5, the hanger 200 comprises a holder 202 attached to a clamp 204. The holder 202 allows the bag 102 to be hung on a rod or other similar objects to keep the hairpiece stored in a safe manner. The holder 202 comprises a hook 206 and a clasp 208. The hook 206 has a curved portion 210 and a stem 212. The curved portion 210 is used to hang the hanger 200 on other objects. The stem 212, defining a stem axis S, allows the hook portion 206 to attach to the clasp 208.

The clasp 208 has a bent arm 220 attached to the stem 212. In the preferred embodiment, the bent arm 220 has a first bend 224 causing a first arm portion 226 to deviate laterally from the stem 212, and a second bend 228 causing a second arm portion 230 to extend towards the stem axis S and terminate in a hair-pin turn 232 under the stem S. The clasp 208 interacts with the clamp 204 to secure the hairpiece in place.

The clamp 204 holds the hairpiece by squeezing the hairpiece in between a pair of clamp arms 240*a*, 240*b*. Each clamp arm 240*a*, 240*b* comprises a top side 242*a*, 242*b*, opposing lateral sides 244*a*, 244*b*, 246*a*, 246*b* adjacent to the top side 242*a*, 242*b*, a bottom side 248*a*, 248*b* opposite the top side 242*a*, 242*b* and adjacent to the opposing lateral sides 244*a*, 244*b*, 246*a*, 246*b* an interior face 250*a*, 250*b* bound by the top side 242*a*, 242*b*, the opposing lateral sides 244*a*, 244*b*, 246*a*, 246*b* and the bottom side 248*a*, 248*b* and an exterior face 252*a*, 252*b* bound by the top side 242*a*, 242*b*, the opposing lateral sides 244*a*, 244*b*, 246*a*,246*b* and the bottom side 248*a*, 248*b* wherein each interior face 250*a*, 250*b* is configured to mate with the other when in a clamped configuration. In the preferred embodiment, each interior face 250*a*, 250*b* comprises a concave middle portion 254*a*, 254*b* approximately equidistant and in between the opposing lateral sides 244*a*, 244*b*, 246*a*, 246*b*. When in the clamped configuration, the concave middle portions 254*a*, 254*b* define a channel 256. In some embodiments, the interior faces 250*a*, 250*b* may have score lines, protrusions, or other texturing to improve the ability to grip a hairpiece clamped therebetween.

The clamp 204 may further comprise a pair of retaining rods 260, 262 that facilitates closure or clamping of the clamp arms 240*a*, 240*b*, one retaining rod for each clamp arm. The first retaining rod 260 comprises a first pair of support rods 264, 266 extending upwardly from the top side 242*a* of the first clamp arm 240*a* and away from the bottom side 248*a* of the clamp arm 240*a*. The first pair of support rods 264, 266 is bilaterally arranged about the concave middle portion 254*a* of the first clamp arm 240*a*. Each of the support rods 264, 266 of the first pair of support rods peaks at a loop portion 268, 270. From each loop portion 268, 270, the supporting rods deviate downwardly back towards the top side 242*a* of the first clamp arm 240*a* and converge centrally above the concave middle portion 254*a* of the first clamp arm 240*a* at a first horizontal rod 272.

A second retaining rod 262 comprises a second pair of support rods 280, 282, the second pair of support rods 280, 282 extending upwardly from the top side 242*b* and away from the bottom side 248*b* of a second clamp arm 240*b*. The second pair of support rods 280, 282 is bilaterally arranged about the concave middle portion 254*b* of the second clamp arm 240*b*. Each of the support rods 280, 282 of the second pair of support rods peaks at a cork-screw loop portion 284, 286. From each cork-screw loop portion 284, 286, the supporting rods deviate downwardly back towards the top side 242*b* and the exterior face 252*b* of the second clamp arm 240*b* and converge centrally above the exterior face 252*b* of the second clamp arm 240*b* at a second horizontal rod 288, such that the first horizontal rod 272 and the second horizontal rod 288 are parallel to each other. Furthermore, each cork-screw loop 284, 286 wraps around one of the loop portions 268, 270 of the first support rods 264, 266 as they make their downward deviation. The first horizontal rod 272 and the second horizontal rod 288 are configured such that when the hair-pin turn 232 of the clasp 208 hooks the second horizontal rod 288, the clasp 208 is rotatable about the second horizontal rod 288 to a closed configuration and an open configuration. In the closed configuration, the second bend 228 is hooked on the first horizontal rod 272 causing the interior faces 250*a*, 250*b* of the first and second clamp arms 240*a*, 240*b* to mate with each other to clamp a hairpiece 10 therebetween. Therefore, the clasp 208 operates to lock the clamp arms 240*a*, 240*b* in a clamped configuration by imparting a force on the pair of retaining rods. In the open configuration, the first horizontal bar 272 is released from the second bend 228, which releases the first clamp arm 240*a* from the second clamp arm 240*b*.

In a preferred embodiment, the elongated bag may have a width W of approximately 15 inches or less and a height H of approximately 36 inches or less. More preferably, the width W is approximately 10 inches to approximately 11 inches and the height H is approximately 25 inches to approximately 27 inches. Each clamp arm may have a length L of less than 12 inches, and a combined thickness of 1 inch or less. More preferably, each clamp arm has a length L of approximately 9 inches.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A hair carrying device, comprising:

a. an elongated bag comprising a top edge, a bottom edge opposite the top edge, a first side edge adjacent to the top edge and the bottom edge, and a second side edge opposite the first side edge and adjacent to the top edge and the bottom edge, a front side bound by the top edge, the bottom edge, the first side edge, and the second side edge, and a back side opposite the front side and operatively connected to the front side along at least the first side edge, the second side edge, and the bottom edge, a distance from the bottom edge to the top edge defining a height, and a distance from the first side edge to the second side edge defining a width, i. wherein the front side comprises a central opening along a central line equidistant from the first side edge and the second side edge, and a fastener associated with the central opening to close the central opening, the fastener extending substantially from the bottom edge to at least approximately 70 percent of the height towards the top edge, wherein approximately 70 percent of the front side is transparent, ii. wherein the back side is substantially opaque, iii. wherein the top edge and the first side edge define a first obtuse angle, and the top edge and the second side edge define a second obtuse angle, and wherein the top edge comprises a central slit; and b. a hanger, comprising:

i. a holder, comprising a hook and a clasp, the book having a curved portion and a stem, the stem defining a stem axis, the clasp attached to the stem, the clasp having a bent arm attached to the stem, the beat arm having a first bend causing a first arm portion to deviate laterally from the stem, and a second bend causing a second arm portion to extend towards the stem axis and terminating in a hair-pin turn under the stem; and ii. a clamp, comprising a pair of clamp arms, and a pair of retaining rods, one retaining for each clamp arm, wherein each clamp arm comprises a top side, opposing lateral sides adjacent to the top side, a bottom side opposite the top side and adjacent to the opposing lateral sides, an interior face bound by the top side, the opposing lateral sides, and the bottom side, and an exterior face bound by the top side, the opposing lateral sides, and the bottom side, wherein each interior face is configured to mate with the other in a clamped configuration, wherein each interior face comprises a concave middle portion approximately equidistant in between their respective opposing lateral sides, wherein when in the clamped configuration, the concave middle portions define a channel, and wherein a first retaining rod comprises a first pair of support rods extending upwardly from the top side and away from the bottom side of a first clamp arm, the first par of support rods bilaterally arranged about the concave middle portion of the first clamp arm, each of the support rods of the first pair of support rods peaking at a loop portion, wherein from each loop portion, the supporting rods deviate downwardly back towards the top side of the first clamp arm and converge centrally above the concave middle portion of the first clamp arm at a first horizontal rod, wherein a second retaining rod comprises a second pair of support rods extending upwardly from the top side and away from the bottom side of a second clamp arm, the second pair of support rods bilaterally arranged about the concave middle portion of the second clamp arm, each of the support rods of the second pair of support rods peaking at a cork-screw loop portion, wherein from each cork-screw loop portion, the supporting rods deviate downwardly back towards the top side and the exterior face of the second clamp arm and converge centrally above the exterior face of the second clamp arm at a second horizontal rod, wherein each cork-screw loop wraps around one of the loop portions of the first support rods such that the first horizontal rod and the second horizontal rod are parallel to each other, and the first horizontal rod and the second horizontal rod are configured such that when the hair-pin turn hooks the second horizontal rod, the clasp is rotatable about the second horizontal rod to a closed configuration and an open configuration, wherein in the closed configuration, the second bend is hooked on the first horizontal rod causing the interior faces of the first and second clamp arms to mate with each other to clamp a hairpiece therebetween, wherein in the open configuration, the first horizontal bar is released from the second bend releasing the first clamp arm from the second clamp arm.

* * * * *